US009915121B2

(12) United States Patent
Limb et al.

(10) Patent No.: US 9,915,121 B2
(45) Date of Patent: Mar. 13, 2018

(54) SEAL PRESSURE RELAXATION DEVICE PRIOR TO RELEASE OF RETRIEVABLE PACKER

(71) Applicant: BAKER HUGHES INCORPORATED, Houston, TX (US)

(72) Inventors: Christopher J. Limb, Cypress, TX (US); Larry J. Urban, Santa Fe, TX (US); Frank Maenza, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 400 days.

(21) Appl. No.: 14/740,670

(22) Filed: Jun. 16, 2015

(65) Prior Publication Data

US 2016/0369585 A1 Dec. 22, 2016

(51) Int. Cl.
*E21B 33/128* (2006.01)
*E21B 33/129* (2006.01)

(52) U.S. Cl.
CPC ..... *E21B 33/128* (2013.01); *E21B 33/129* (2013.01)

(58) Field of Classification Search
CPC ..... E21B 33/129; E21B 33/128–33/12955
USPC ..... 166/318
See application file for complete search history.

(56) References Cited

U.S. PATENT DOCUMENTS

| | | | | |
|---|---|---|---|---|
| 8,291,989 | B2 | 10/2012 | Kilgore | |
| 2002/0121379 | A1 | 9/2002 | Doane | |
| 2005/0077053 | A1 | 4/2005 | Walker et al. | |
| 2012/0160523 | A1 | 6/2012 | Burgos | |
| 2014/0209321 | A1 | 7/2014 | Hansen et al. | |
| 2016/0326831 | A1* | 11/2016 | Reinhardt | E21B 33/1285 |

FOREIGN PATENT DOCUMENTS

WO 2011075247 A2 6/2011

* cited by examiner

*Primary Examiner* — George S Gray
(74) *Attorney, Agent, or Firm* — Steve Rosenblatt

(57) ABSTRACT

A retrievable packer has its sealing system unloaded before the slip system is relaxed by separation of slip cones from slips that flank the seal assembly. The mandrel is cut so that the portion above the cut can be raised to take a cone up and away from collet heads which previously were trapped by the cone. The collet heads are disposed between opposed sloping surfaces so that the retraction of the cone from under the heads allows the residual rubber pressure to force the heads toward the mandrel into the space created by relative movement of the mandrel that took the wedge cone uphole. The heads are at ends of fingers having a radially inward bias to further assist retraction of the heads toward the mandrel. With the heads retracted the sealing element stretches out before slip cones are moved relative to the slips.

18 Claims, 4 Drawing Sheets

SEAL PRESSURE RELAXATION DEVICE PRIOR TO RELEASE OF RETRIEVABLE PACKER

FIELD OF THE INVENTION

The field of the invention is retrievable packers or plugs and more particularly where the seal assembly can be unset before the slips are released to facilitate retrieval of the packer or plug.

BACKGROUND OF THE INVENTION

Retrievable packers or plugs typically have a multi-element sealing system between upper and lower slips. When set mechanically with a known setting tool relative movement is created when the outer assembly of slips and the sealing system are pushed on while the setting tool pulls on the mandrel at the same time. Generally, the result is that the upper slips set and then the seal is axially compressed followed by the extension of the lower slips. The outer assembly features a lock ring that can hold the outer assembly is the compressed and set position. The release occurs when the lock ring that fixates the outer assembly with respect to the mandrel is defeated. Defeating the locking mechanism can occur with a mandrel pull that shears a retainer or with cutting the mandrel to allow the outer assembly to relax or by running a tool into the mandrel to forcibly defeat a shear device that holds the set of the outer assembly.

One potential problem with releasing the outer assembly components at the same time is the potential for binding the slips with the released rubber pressure in the sealing element assembly causing one of the slip assemblies to bind. One way to alleviate this problem is to provide a mechanism that is designed to relieve rubber pressure on the seal assembly before releasing the slips. While that is the intention of the device shown in U.S. Pat. No. 8,291,989 FIG. 2B using engaged threads 75 and 76 and selectively raising a mandrel slot 78 into alignment with threads 75 to let fingers 73 flex toward the mandrel with the hope that a separation will occur, the reality is that the force holding threads 75 and 76 in the set position can be so strong such that aligning the slot 78 will still not result in a release of the pressure in the seal assembly 42. What is needed and provided by the present invention is a rubber pressure release system where mandrel movement takes with it initially a part of the outer assembly that underpins a lock for the set of the sealing system and provides a large space outside the mandrel for the force of the retained rubber pressure to forcibly push the locking member to retract in a radial direction by including a radial component of the release force toward the mandrel topromote lock retraction. The lock has a wedge pulled out from under it to allow it to flex toward the mandrel outer surface and to be pushed by the force of the relaxing seal assembly. These and other aspects of the present invention will be more readily apparent to those skilled in the art from a review of the description of the preferred embodiment and the associated drawings while understanding that the full scope of the invention is to be determined from the appended claims.

SUMMARY OF THE INVENTION

A retrievable packer has its sealing system unloaded before the slip system is relaxed by separation of slip cones from slips that flank the seal assembly. The mandrel is cut so that the portion above the cut can be raised to take a cone up and away from collet heads which previously were trapped by the cone. The collet heads are disposed between opposed sloping surfaces so that the retraction of the cone from under the heads allows the residual rubber pressure to force the heads toward the mandrel into the space created by relative movement of the mandrel that took the wedge cone uphole. The heads are at ends of fingers having a radially inward bias to further assist retraction of the heads toward the mandrel. With the heads retracted the sealing element stretches out before slip cones are moved relative to the slips.

DETAILED DESCRIPTION OF THE PREFERRED EMBODIMENT

Figure 1:
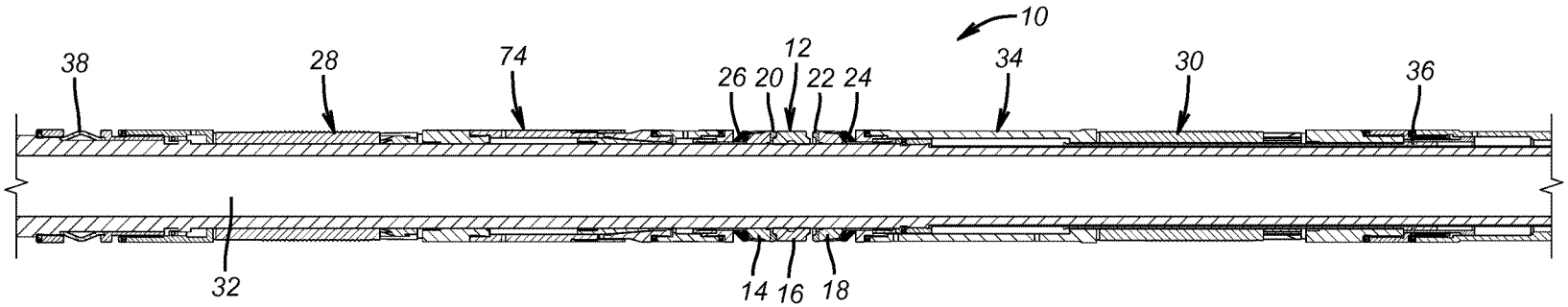
FIG. 1 is a section view of the packer or plug in the run in position.
Figure 2:
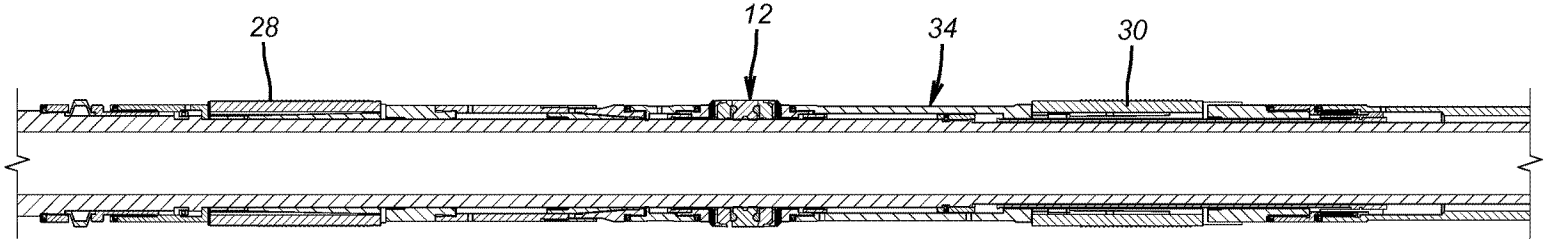
FIG. 2 is the view of FIG. 1 in the set position.

Referring to FIG. 1, the packer or plug 10 has a sealing element assembly 12 that comprises rings 14, 16 and 18 separated by spacers 20 and 22. Anti-extrusion assemblies 24 and 26 flank the sealing element assembly 12. Slip assemblies 28 and 30 flank the sealing element assembly 12. Mandrel 32 supports the above described components as an outer assembly 34. A lock ring assembly 36 holds the set position of the packer or plug 10. A folding debris barrier 38 is compressed to extend out radially when the packer or plug 10 is set hydraulically, hydrostatically or with a setting tool that is not shown that selectively grips the mandrel 32 while pushing on the outer assembly 34. The packer is released by a cutting tool that cuts the mandrel 32 to the right or further downhole from the lock ring assembly 36. As thus far described the packer or plug and its setting and release are a design that is known in the art. FIG. 2 simply shows the same packer or plug as thus far described in the set position.

Figure 3:
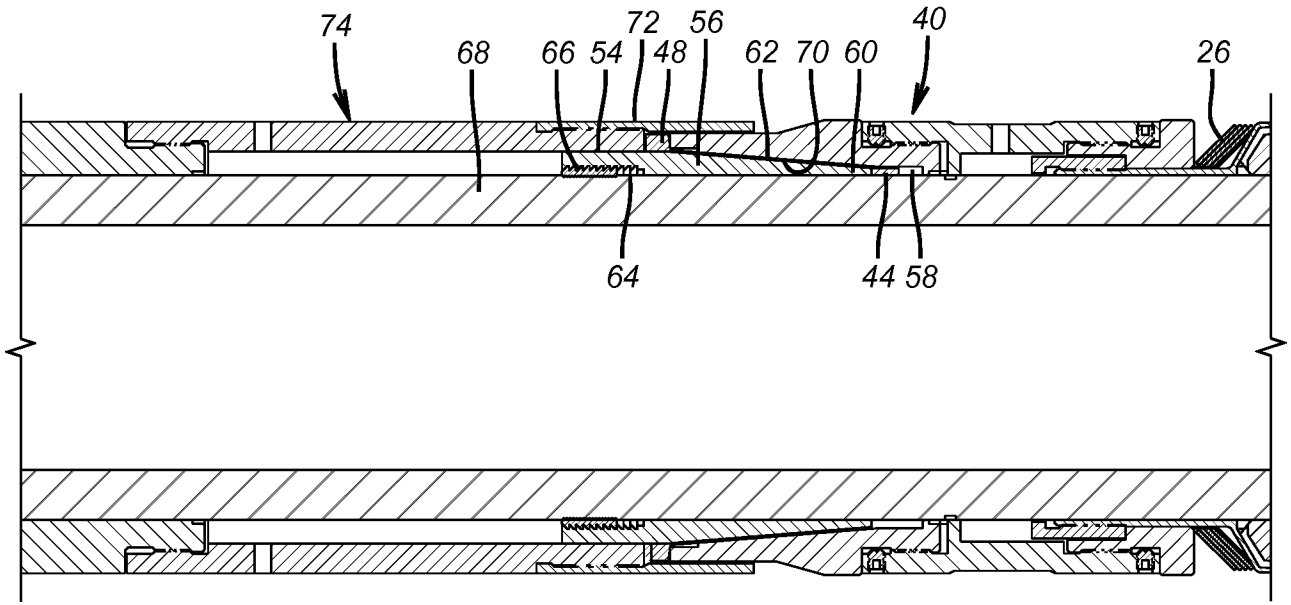
FIG. 3 is a detailed view of the lock mechanism in the set position of FIG. 2.
Figure 4:
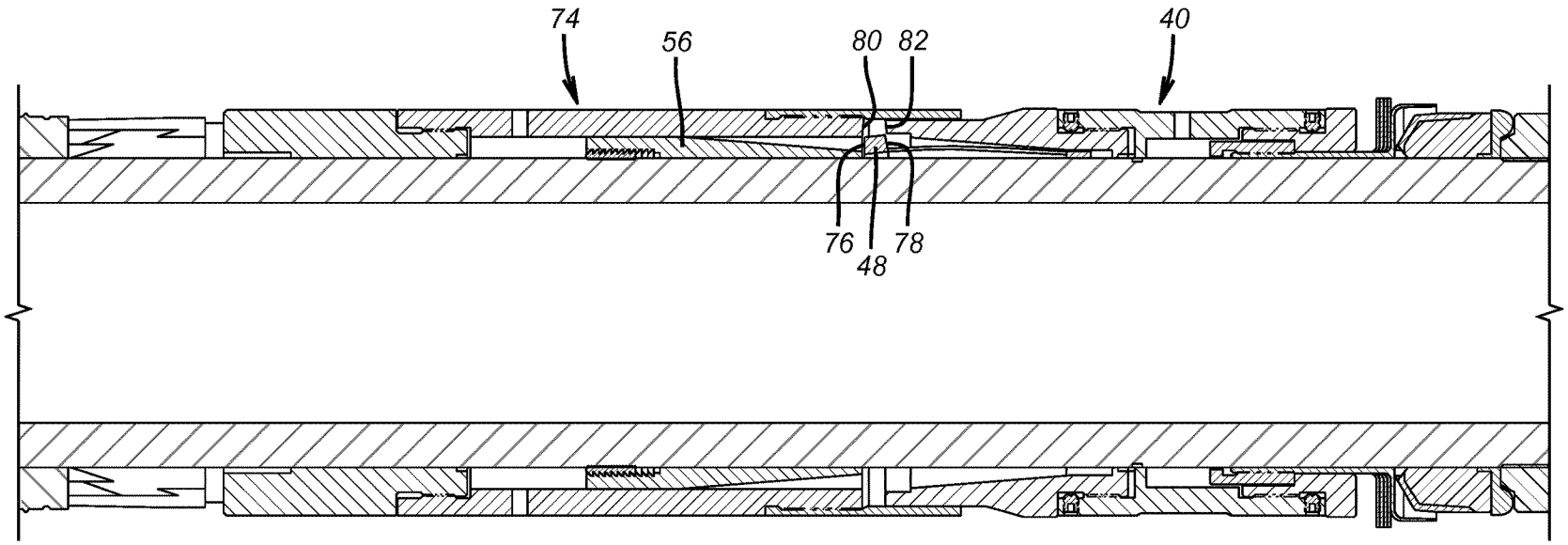
FIG. 4 is a detailed view of the lock mechanism in the released position.
Figure 5:
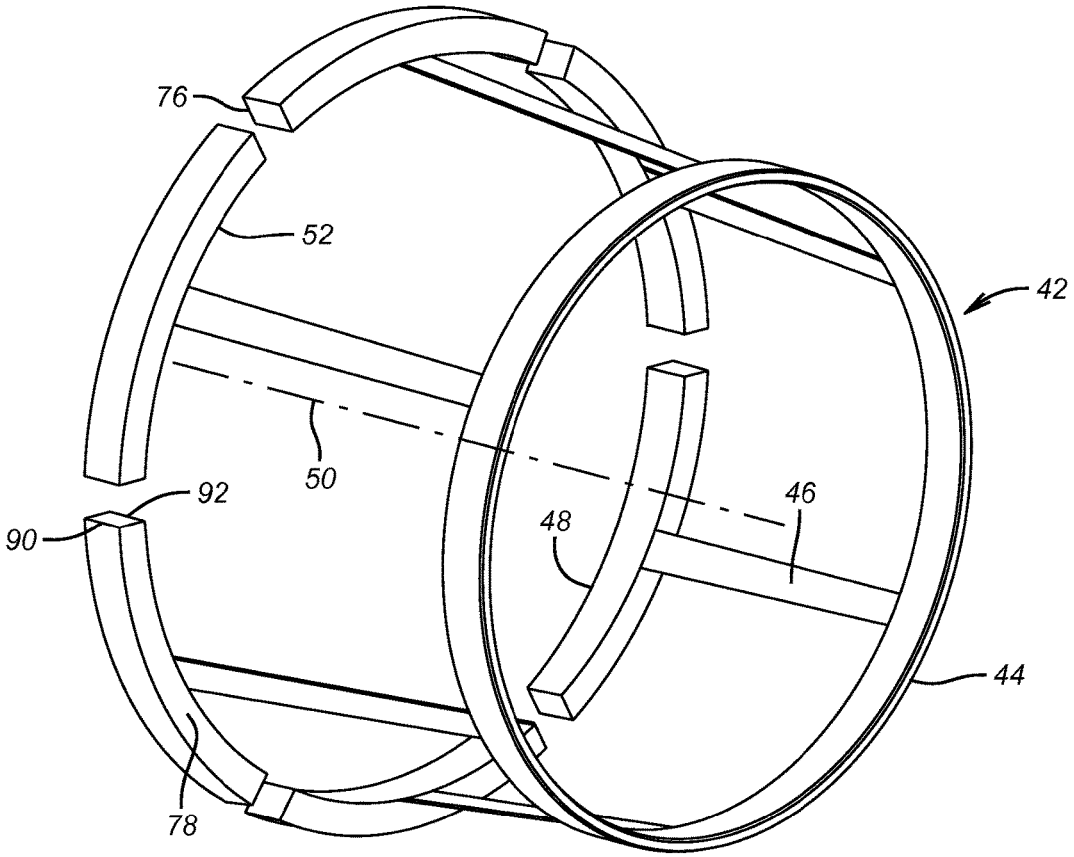
FIG. 5 is an isometric view of the lock assembly.

FIGS. 3-5 show the unique features of the packer or plug 10 of the present invention in a scale larger than FIGS. 1 and 2 to facilitate explanation of their operation. FIG. 3 shows a close up view uphole of optional the anti-extrusion assembly 26 that is also shown in FIG. 1. Lower collet cone assembly 40 is part of the outer assembly 34. FIG. 5 shows a perspective view of the collet assembly 42 which has a base ring 44 from which an array of extending fingers 46 extend generally radially into circumferential segments or collet heads 48. Six such equally spaced assemblies are shown but more or fewer can be used. The distance from axis 50 to the inside surfaces 52 is preferably smaller than the outside diameter 54 of the lock ring carrier 56 so that on assembly as shown in FIG. 3 the heads 48 are pushed out to create a potential energy force to retract toward the mandrel 32 when carrier 56 is moved to the FIG. 4 position for release of the packer or plug 10. As shown in FIG. 3, assembly 40 retains ring 44 to the mandrel 32 using an undercut 58 and the lower end 60 of ramp 62 on carrier 56. Carrier 56 also has another undercut 64 that holds a body lock ring 66. Lock ring 66 can ratchet up profile 68 during setting as the outer assembly 34 and mandrel 32 move relatively. During the setting the carrier 56 and lock ring 66 move in tandem up profile 68 from the FIG. 3 position. Downward movement of the carrier 56 after the set position is reached with respect to mandrel 32 is not possible. However, after the mandrel 32 is cut, the portion of mandrel 32 above the cut (not shown) can be brought uphole taking with mandrel 32 the carrier 56 and lock ring 66. During the setting force is transmitted through the seal assembly 12 into assembly 40. Ramp 70 is in contact with ramp 62 for tandem movement of assembly 40 and carrier 56. Also moving in tandem are heads 48 contained by sleeve 72 that is attached to actuation assembly 74 that interacts with upper slip assembly 28 to set it in the known way. Setting force after run in in the FIG. 3 position is transmitted through heads 48 that are contained on four sides by the carrier 56, the sleeve 72, assembly 40 and assembly 74. During setting from the FIG. 3 position, the outer assembly moves with respect to mandrel 32 to compress the sealing assembly 12 to a sealing position against a surrounding tubular that is not shown and rides the slip assemblies 28 and 30 out to that same tubular on adjacent ramps. The set position is held with lock ring assembly 36.

Looking at FIG. 4, the heads 48 have beveled upper surface 76 and beveled lower surface 78. Corresponding surfaces 80 on assembly 74 and 82 on assembly 40 are similarly beveled so that the surfaces preferably abut at an angle of between 1 and 45 degrees with respect to the axis of the mandrel 32. In that sense there are two forces urging the heads 48 toward the mandrel 32 after upward movement of the mandrel 32 after the mandrel is severed pulls up carrier 56 from under heads 48 as shown in FIG. 4. One is the fact that the fingers 46 carry a potential energy force toward mandrel 32 because on assembly heads 48 had to be outwardly pushed out. These fingers apply a restorative force to the heads 48 in a radial direction toward mandrel 32. The other force toward movement of heads 48 toward mandrel 32 in the FIG. 4 position is the sloping surfaces on opposed sides 76 and 78 of heads 48 and the corresponding sloping surfaces 80 and 82 that interact with them. This makes the cross-sectional shape of heads 48 trapezoidal with the larger of the opposed parallel surfaces 90 and 92 facing mandrel 32. As the carrier 56 comes uphole with mandrel 32 to create a way for the heads to move radially toward the outer surface of the mandrel 32 the released pressure contained in the sealing assembly 12 pushes up surface 82 which due to its slope creates a radial force component on heads 48 toward mandrel 32. The same thing happens as heads 48 interact with sloping surface 80 so that on opposed sides of the heads 48 a radial force component is created to move the heads 48 radially inwardly toward mandrel 32 which then allows assembly 40 to move up into the void created by the retraction of the heads 48 so that the seal assembly 12 can retract.

The differences from the design in U.S. Pat. No. 8,291,989 are notable. The release movement occurs outside the mandrel 32 rather than a notch in the outer surface of the mandrel. The release comprises movement into a created space that is urged by the stored potential energy in the collet heads from fingers 46 and from the interaction of tapered surfaces on the heads 48 on opposed sides with adjacent surfaces to create a radial force toward the mandrel 32 due to the tapered surfaces abutting and the pushing from the seal assembly 12 relaxing. In essence the opposed tapers on the heads and the abutting surfaces take the axial force from the relaxation of the sealing assembly 12 and create a radial component of force toward the mandrel 32 as the heads retract into the newly formed space as ramp 62 is pulled away from ramp 70 to put all the above described parts into motion as explained above. These feature assure the release of the pressure in the sealing assembly 12 before further mandrel movement allows the slip assemblies 28 and 30 to retract. It is also notable that unlike the design in U.S. Pat. No. 8,291,989 the release of the seal assembly 12 does not entail relativeaxial motion of formerly meshing thread patterns. The setting force is held through heads 48 rather than the structurally weaker mating thread patterns in U.S. Pat. No. 8,291,989. Additionally, the heads 48 are far better isolated from debris in the borehole than in U.S. Pat. No. 8,291,989. The cavity into which the c-ring 75 in U.S. Pat. No. 8,291,989 is pushed has to be open to well fluid to avoid liquid lock as sleeve 72 moves up. Also item 75 in this patent is a split c-ring that can let in debris in the gap in the set position. This exposes the annular space within item 12 in FIG. B to debris buildup that can prevent release. The heads 48 move into a newly created space upon movement of mandrel 32 so that debris is effectively kept out of the location where the heads 48 need to move. The overlying sleeve 72 also keeps debris away from heads 48 insuring that they will operate to release the plug or packer 10 when needed.

The above description is illustrative of the preferred embodiment and many modifications may be made by those skilled in the art without departing from the invention whose scope is to be determined from the literal and equivalent scope of the claims below:

We claim:

1. A retrievable packer or plug assembly, comprising:

an outer assembly mounted to a mandrel, said outer assembly comprising a sealing assembly comprising a seal, and a slip assembly, said outer assembly selectively movable between a retracted run in position and a set position where said sealing and slip assemblies engage a surrounding tubular;

said sealing assembly being releasable from said set position before said slip assembly, in response to mandrel movement, said mandrel movement allowing at least one lock that transmits bearing force therethrough from said sealing assembly to said slip assembly when in said set position, to move into a space created between said lock and said mandrel by movement of a part of said outer assembly with said mandrel, said lock movement being substantially transverse to a longitudinal axis of said mandrel.

2. The assembly of claim 1, wherein:

said part of said outer assembly moving with said mandrel to create said space comprises a carrier comprising a ramp.

3. The assembly of claim 2, wherein:

said carrier moving relative to said mandrel from said retracted to said set positions of said outer assembly.

4. The assembly of claim 2, wherein:

said carrier moving with said mandrel from said set to a released position of said outer assembly.

5. The assembly of claim 2, wherein:

said at least one lock comprising a collet head mounted on a finger attached to a base ring;

said at least one head when assembled over an outer surface of said carrier flexes said finger for storing a restorative potential energy force, said restorative potential energy force moves said head into said created space as said ramp is presented in opposition to said at least one head.

6. A retrievable packer or plug assembly, comprising:

an outer assembly mounted to a mandrel, said outer assembly comprising a sealing assembly comprising a seal and a slip assembly, said outer assembly selectively movable between a retracted run in position and a set position where said sealing and slip assemblies engage a surrounding tubular;

said sealing assembly being releasable from said set position before said slip assembly, in response to mandrel movement, said mandrel movement allowing at least one lock that transmits bearing force therethrough from said sealing assembly to said slip assembly when in said set position, to move into a space created between said lock and said mandrel by movement of a part of said outer assembly with said mandrel;

said part of said outer assembly moving with said mandrel to create said space comprises a carrier comprising a ramp;

said carrier mounted to said mandrel with a ratcheting lock ring assembly in between.

7. A retrievable packer or plug assembly, comprising:

an outer assembly mounted to a mandrel, said outer assembly comprising a sealing assembly comprising a seal and a slip assembly, said outer assembly selectively movable between a retracted run in position and a set position where said sealing and slip assemblies engage a surrounding tubular;

said sealing assembly being releasable from said set position before said slip assembly, in response to mandrel movement, said mandrel movement allowing at least one lock that transmits bearing force therethrough from said sealing assembly to said slip assembly when in said set position, to move into a space created between said lock and said mandrel by movement of a part of said outer assembly with said mandrel;

said part of said outer assembly moving with said mandrel to create said space comprises a carrier comprising a ramp;

said at least one lock comprising a collet head mounted on a finger attached to a base ring;

said head transmits said bearing force through opposed sloping surfaces that in part define a trapezoidal shape in cross-section.

8. The assembly of claim 7, wherein:

said trapezoidal cross sectional shape further defined by opposed parallel surfaces with the wider of said parallel surfaces disposed facing said mandrel.

9. The assembly of claim 8, wherein:

said collet head sloping surfaces each opposed by a respective parallel outer assembly sloping surface, such that on movement of said ramp away from said head, axial force delivered from said seal assembly creates a radial component of force toward said mandrel on said heads resulting from said opposed sloping bearing surfaces on said head.

10. The assembly of claim 9, wherein:

said at least one lock comprises a plurality of heads each supported on a respective finger extending from said base ring.

11. A retrievable packer or plug assembly, comprising:

an outer assembly mounted to a mandrel, said outer assembly comprising a sealing assembly comprising a seal and a slip assembly, said outer assembly selectively movable between a retracted run in position and a set position where said sealing and slip assemblies engage a surrounding tubular;

said sealing assembly being releasable from said set position before said slip assembly, in response to mandrel movement, said mandrel movement allowing at least one lock that transmits bearing force therethrough from said sealing assembly to said slip assembly when in said set position, to move into a space created between said lock and said mandrel by movement of a part of said outer assembly with said mandrel;

said part of said outer assembly moving with said mandrel to create said space comprises a carrier comprising a ramp;

said at least one lock comprising a collet head mounted on a finger attached to a base ring;

said collet head forced toward said mandrel by forces from flexing of said finger and at least one inclined surface on said collet head, the forces being discrete.

12. The assembly of claim 11, wherein:

one of said forces comprises a compressive force on said sealing assembly.

13. The assembly of claim 12, wherein:

said compressive force on said sealing assembly applied in a direction along an axis of said mandrel to said at least one inclined surface on said head to create a radial force component on said head toward said mandrel.

14. The assembly of claim 13, wherein:

said at least one inclined surface comprises opposed inclined surfaces on said head giving it a trapezoidal cross-section.

15. The assembly of claim 14, wherein:

said opposed inclined surfaces on said head opposed by respective parallel surfaces on said outer assembly.

16. A retrievable packer or plug assembly, comprising:

an outer assembly mounted to a mandrel, said outer assembly comprising a sealing assembly comprising a seal and a slip assembly, said outer assembly selectively movable between a retracted run in position and a set position where said sealing and slip assemblies engage a surrounding tubular;

said sealing assembly being releasable from said set position before said slip assembly, in response to mandrel movement, said mandrel movement allowing at least one lock that transmits bearing force therethrough from said sealing assembly to said slip assembly when in said set position, to move into a space created between said lock and said mandrel by movement of a part of said outer assembly with said mandrel;

said part of said outer assembly moving with said mandrel to create said space comprises a carrier comprising a ramp;

said at least one lock comprising a collet head mounted on a finger attached to a base ring;

said collet head disposed between an outer cylindrical surface of said carrier and a surrounding outer sleeve in said run in position to keep debris away from said head, said ramp whose movement creates said space for said head to move toward said mandrel further keeping debris out of said space until said space is created by movement of said ramp with respect to said head.

17. The assembly of claim 16, wherein:

said carrier moving relative to said mandrel from said retracted to said set positions of said outer assembly.

18. The assembly of claim 17, wherein:

said carrier moving with said mandrel from said set to a released position of said outer assembly.

* * * * *